US008265533B2

(12) United States Patent
Barton et al.

(10) Patent No.: US 8,265,533 B2
(45) Date of Patent: Sep. 11, 2012

(54) FUSER RELEASE FLUID RATE TRANSIENT CONTROL VIA VARIABLE SPEED OIL METERING SYSTEM

(75) Inventors: Augusto E. Barton, Webster, NY (US); Paul M. Fromm, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 169 days.

(21) Appl. No.: 12/822,399

(22) Filed: Jun. 24, 2010

(65) Prior Publication Data

US 2011/0318072 A1 Dec. 29, 2011

(51) Int. Cl.
*G03G 15/20* (2006.01)

(52) U.S. Cl. ..... 399/325

(58) Field of Classification Search ..... 399/325, 399/327; 347/85

See application file for complete search history.

(56) References Cited

U.S. PATENT DOCUMENTS 5,200,786 A * 4/1993 Fromm et al. ..... 399/325
7,054,588 B2 * 5/2006 Wu et al. ..... 399/325
2010/0079560 A1 4/2010 Derimiggio et al.

* cited by examiner

*Primary Examiner* — Walter L Lindsay, Jr.
*Assistant Examiner* — Barnabas Fekete
(74) *Attorney, Agent, or Firm* — Ronald E. Prass, Jr.; Prass LLP

(57) ABSTRACT

An apparatus for applying release agent to a fuser roll used in printing a print job is provided. The apparatus has a release agent metering roll supported for contact with a supply of release agent material; a variable speed drive arranged to effect movement of the release agent metering roll in an endless path at different surface velocities; a donor roll supported in contact with the release agent metering roll and the fuser roll, the donor roll arranged to convey release agent material from the release agent metering roll to the fuser roll at various rates depending on a surface velocity of the release agent metering roll; and a controller that controls a velocity of the variable speed drive such that the surface velocity of the release agent metering roll varies relative to a surface velocity of the fuser roll and the engagement and disengagement times at the start and end of the print job. The variable speed drive is operative independently of the fuser roll.

16 Claims, 3 Drawing Sheets

FUSER RELEASE FLUID RATE TRANSIENT CONTROL VIA VARIABLE SPEED OIL METERING SYSTEM

RELATED APPLICATIONS

This application is related to the application entitled "Variable Rate Fuser Release Fluid Application," Ser. No. 12/243,380, which was filed on Oct. 1, 2008, which is commonly assigned to the assignee of the present application, and which is incorporated herein by reference in its entirety.

BACKGROUND

The present disclosure relates generally to fuser release fluid application in imaging systems. More particularly, the present disclosure describes an apparatus, method, and system useful for controlling variations in fuser release fluid rates in imaging systems.

Many fusers use release agent to reduce adhesion of the toner to the fusing surface. The amount of release agent, typically oil, on the printed media is kept within a certain range to assure proper release, and minimized to avoid problems in using the prints (for example, writing on the prints, binding, or laminating). Release agent application devices are designed to assure a nominal oil rate and limit oil transients. The oil transient gives higher oil rates at the beginning of a run and then lowers to a steady state level during the run. The excess oil at the beginning of the run causes poor fusing of the first prints, although this may be mitigated by higher fusing temperatures (also a transient). However, this is not ideal since the combination of excess oil and higher fusing temperature can cause an undesired gloss transient.

SUMMARY

An apparatus for applying release agent to a fuser roll used in printing a print job is provided. The apparatus has a release agent metering roll supported for contact with a supply of release agent material; a variable speed drive arranged to effect movement of the release agent metering roll in an endless path at different surface velocities; a donor roll supported in contact with the release agent metering roll and the fuser roll, the donor roll arranged to convey release agent material from the release agent metering roll to the fuser roll at various rates depending on a surface velocity of the release agent metering roll; and a controller that controls a velocity of the variable speed drive such that the surface velocity of the release agent metering roll varies relative to a surface velocity of the fuser roll during the print job. The variable speed drive is operative independently of the fuser roll.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the present embodiments and further features and advantages thereof may be acquired by referring to the following description taken in conjunction with the accompanying drawings, wherein.

DETAILED DESCRIPTION

Figure 1:
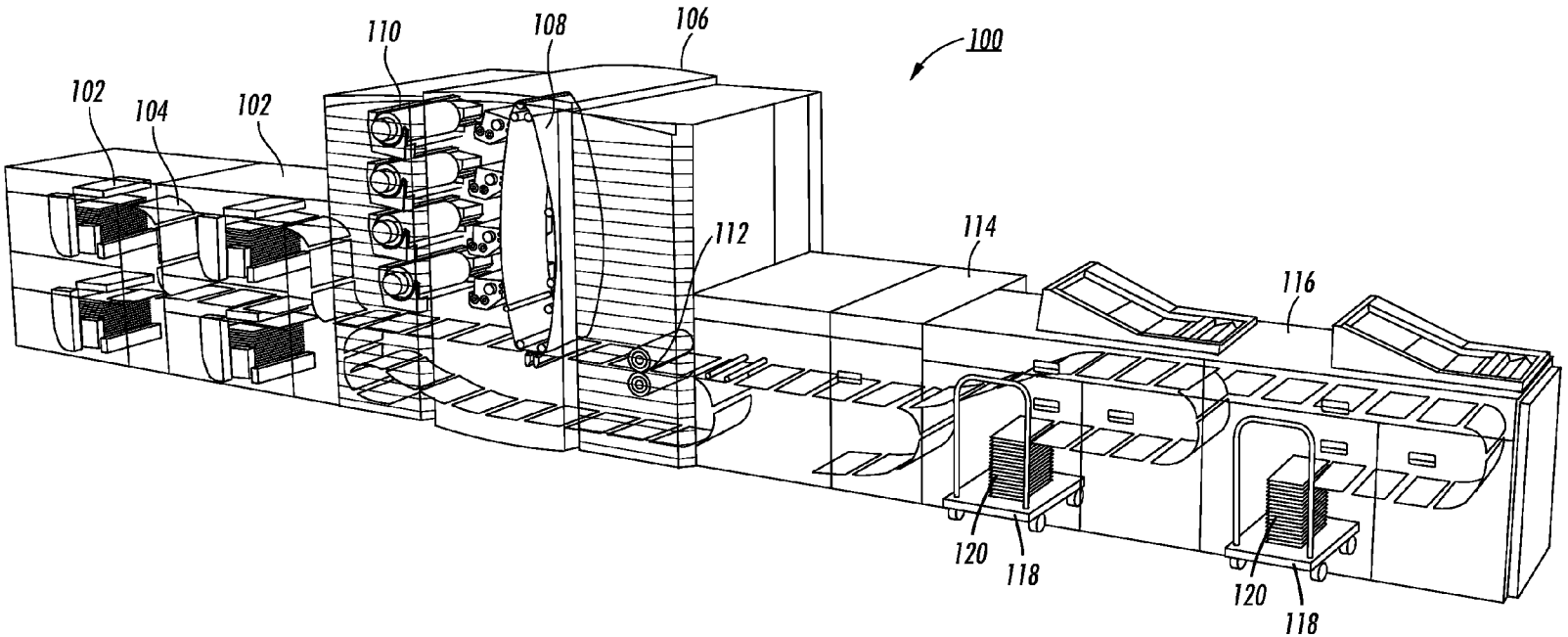
FIG. 1 is an exemplary schematic diagram of a printing device in accordance with embodiments of the disclosure.

Illustrative embodiments are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

The disclosed embodiments may include an apparatus for applying release agent to a fuser roll used in printing a print job. The apparatus has a release agent metering roll supported for contact with a supply of release agent material; a variable speed drive arranged to effect movement of the release agent metering roll in an endless path at different surface velocities; a donor roll supported in contact with the release agent metering roll and the fuser roll, the donor roll arranged to convey release agent material from the release agent metering roll to the fuser roll at various rates depending on a surface velocity of the release agent metering roll; and a controller that controls a velocity of the variable speed drive such that the surface velocity of the release agent metering roll varies relative to a surface velocity of the fuser roll during the print job. The variable speed drive is operative independently of the fuser roll.

The disclosed embodiments may further include a printing apparatus. The printing apparatus has an apparatus for applying release agent to a fuser roll used in printing a print job, the apparatus for applying has a release agent metering roll supported for contact with a supply of release agent material; a variable speed drive arranged to effect movement of the release agent metering roll in an endless path at different surface velocities; a donor roll supported in contact with the release agent metering roll and the fuser roll, the donor roll arranged to convey release agent material from the release agent metering roll to the fuser roll at various rates depending on a surface velocity of the release agent metering roll; and a controller that controls a velocity of the variable speed drive such that the surface velocity of the release agent metering roll varies relative to a surface velocity of the fuser roll during the print job; an image forming unit; and a sheet feed unit that feeds sheets to the image forming unit. The variable speed drive is operative independently of the fuser roll, and the fuser roll fixes to the sheets images formed by the image forming unit.

The disclosed embodiments may further include a method for applying release agent to a fuser roll used in printing a print job. The method includes providing a release agent metering roll supported for contact with a supply of release agent material; providing a variable speed drive arranged to effect movement of the release agent metering roll in an endless path at different surface velocities; providing a donor roll supported in contact with the release agent metering roll and the fuser roll; conveying release agent material from the release agent metering roll to the fuser roll at various rates depending on a surface velocity of the release agent metering roll; and controlling a velocity of the variable speed drive such that the surface velocity of the release agent metering roll varies relative to a velocity of the fuser roll during the print job. The variable speed drive is operated independently of the fuser roll.

FIG. 1 illustrates an exemplary printing apparatus 100. As used herein, the term "printing apparatus" encompasses any apparatus, such as a digital copier, bookmaking machine, multifunction machine, and the like, that performs a print outputting function for any purpose. Printing apparatus 100 can be used to produce prints from various types of media, such as coated or uncoated (plain) paper sheets, at high speeds. The media can have various sizes and weights. In embodiments, printing apparatus 100 has a modular construction. As shown, the apparatus includes two media feeder modules 102 arranged in series, a printer module 106 adjacent media feeding modules 102, an inverter module 114 adjacent printer module 106, and two stacker modules 116 arranged in series adjacent inverter module 114.

In printing apparatus 100, media feeder modules 102 are adapted to feed media having various sizes (widths and lengths) and weights to printer module 106. In printer module 106, toner is transferred from a series of developer stations 110 to a charged photoreceptor belt 108 to form toner images on the photoreceptor belt and produce color prints. The toner images are transferred to one side of respective media 104 fed through the paper path. The media are advanced through a fuser 112 adapted to fuse the toner images on the media. Inverter module 114 manipulates media exiting printer module 106 by either passing the media through to stacker modules 116, or inverting and returning the media to printer module 106. In stacker modules 116, the printed media are loaded onto stacker carts 118 to form stacks 120.

Figure 2:
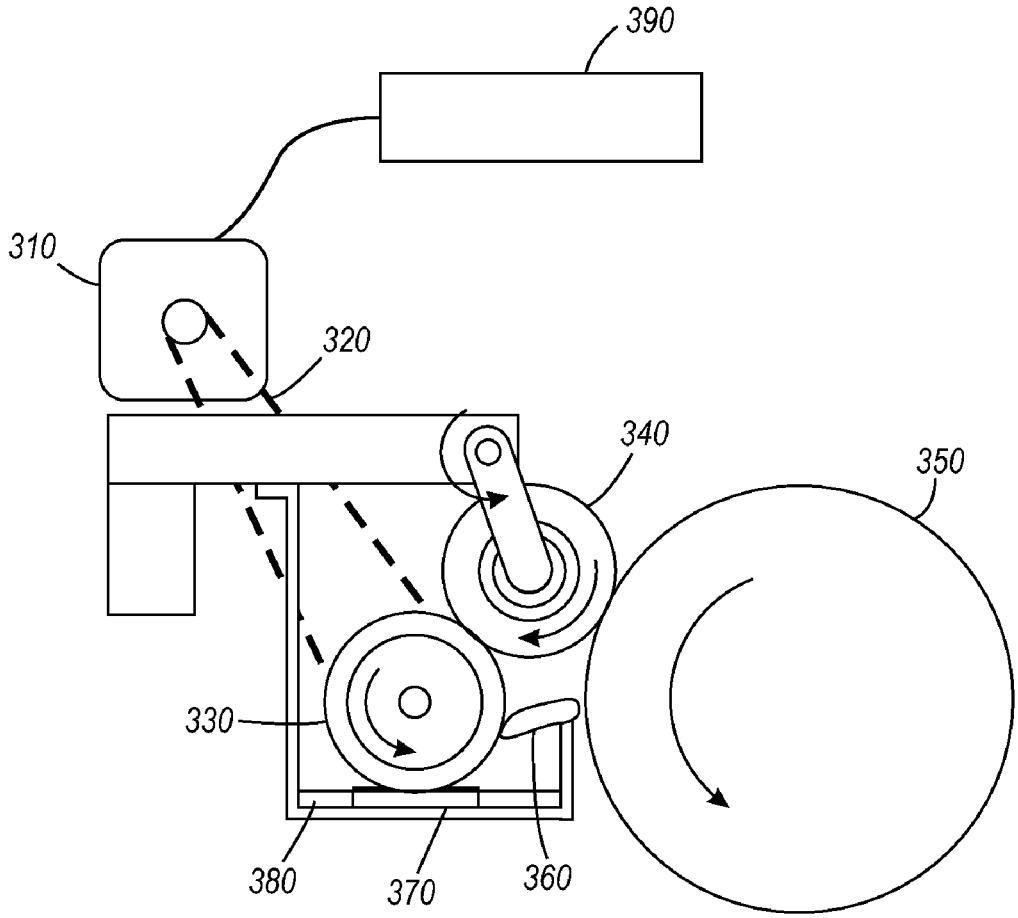
FIG. 2 is an exemplary diagram of a device in accordance with embodiments of the disclosure.

FIG. 2 illustrates an example of a variable speed oil meter (VSM) in accordance with embodiments of the disclosure. FIG. 2 shows a drive motor 310 attached by a belt 320 to a metering roll 330 such that drive motor 310 turns metering roll 330. A controller 390 controls drive motor 310. Metering roll 330 picks up oil 380 from an oil pan 370. Oil 380 adheres to the surface of metering roll 330, is spread in a layer of correct thickness by a metering blade 360, and is then transferred to a donor roll 340. The oil is then transferred from donor roll 340 to a fusing roll (or belt) 350. Fusing roll 350 can correspond to the top roll in fuser 112 shown in FIG. 1, which is the roll that contacts the unfused toner on the printed sheet. As a result, the apparatus shown in FIG. 2 applies a uniform layer of release agent (for example, oil) to the fusing roll in order to reduce adhesion of toner to the fusing surface.

The term "drive" or "drive motor" can apply to any electromechanical arrangement capable of providing a desired rotational speed, and could include, for example, simply an electrical motor, such as a brush, brushless, or stepper motor, with or without accompanying transmission mechanisms. Also, any roll, including a fuser roll, donor roll, or metering roll, can, in alternate embodiments, be in the form of a belt entrained around two or more rollers.

The amount of oil on the fusing surface (and therefore on the printed media) should be within a certain range to assure proper release, and minimized to avoid problems in using the prints (for example, writing on the prints, binding, or laminating). Release agent application devices are designed to assure a nominal oil rate and limit oil transients. A traditional release agent management system (RAM) applies oil to the fuser roll at an idle oil rate (or no oil) when a print job is not running, and at a steady state running oil rate when a print job is running. These systems abruptly change from the idle oil rate to the steady state running oil rate when a print job is started. The oil transient gives higher oil rates at the beginning of a run and then lowers to the steady state level during the run. The excess oil at the beginning of the run causes poor fusing of the first prints, although this may be mitigated by higher fusing temperatures (also a transient). However, this is not ideal since the combination of excess oil and higher fusing temperature can cause an undesired gloss transient.

Embodiments of the disclosure use a VSM to reduce the high oil rate at the beginning of a run. The oil rate at the beginning of the run is controlled by (1) "ramping up" the amount of oil delivered to fusing roll 350 at the beginning of a run instead of abruptly changing from the idle oil rate to the steady state running oil rate, and (2) by "ramping-down" the amount of oil delivered to fusing roll 350 at the end of a run instead of abruptly changing from the steady state running oil rate to the idle oil rate. Embodiments of the disclosure can reduce oil rate transients from the 40% excess seen in traditional systems to a 10% excess.

The terms cam-in, cammed-in, and camming-in refer to the position of the metering roll and the donor roll relative to the fuser roll such that oil is passed from the metering roll to the fuser roll. The terms cam-out, cammed-out, and camming-out refer to the position of the metering roll and the donor roll relative to the fuser roll such that oil is not passed from the metering roll to the fuser roll. In traditional systems the RAM is cammed-in a few seconds before the first print arrives and cams-out a few seconds after the last print leaves. As a result, the fusing surface ends up with more oil on it before the first print arrives than it does during steady-state operation. This is due to the oil being deposited on the fusing surface without any oil being taken away by pages being printed.

Figure 3:
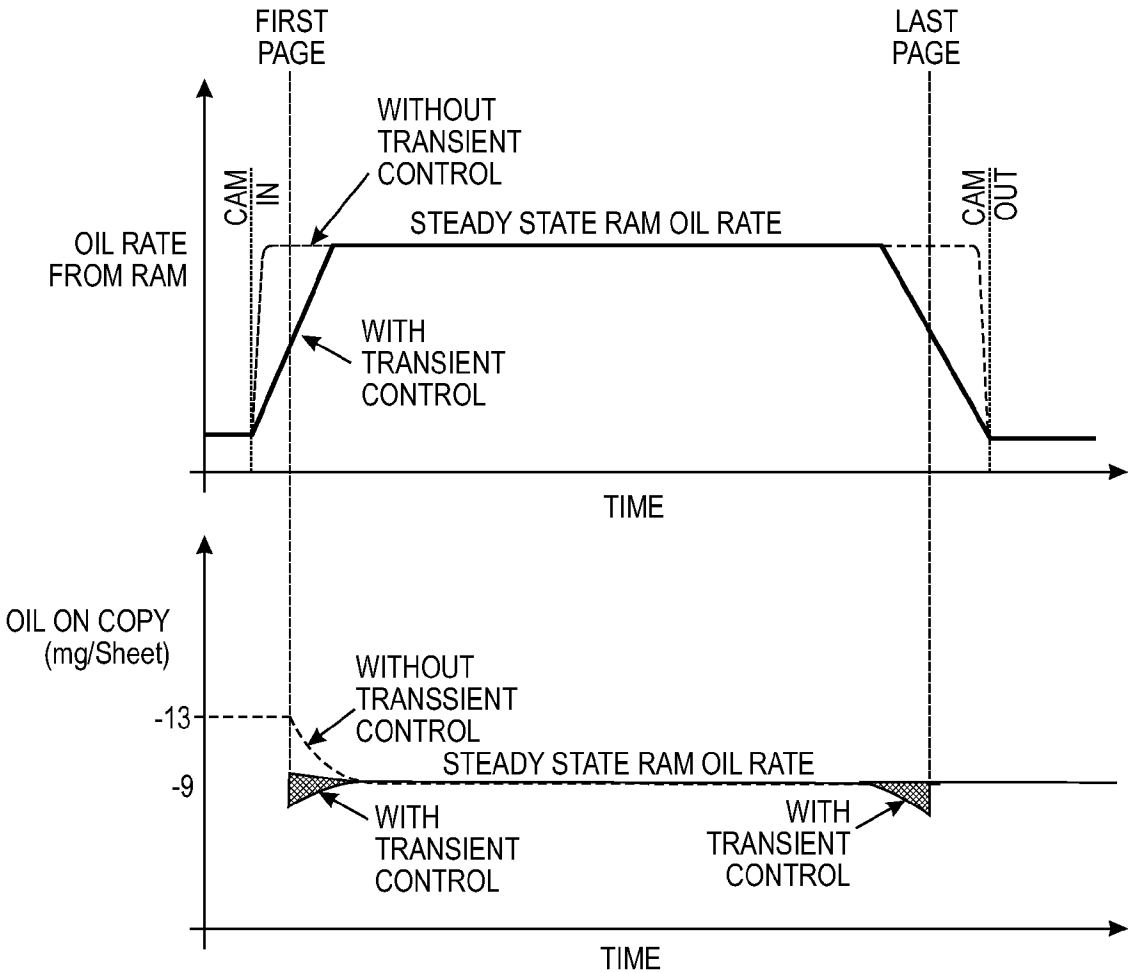
FIG. 3 is an exemplary diagram of a method in accordance with embodiments of the disclosure.

FIG. 3 shows two graphs. One graph in FIG. 3 shows oil rate from the RAM as a function of time, while the other graph shows the amount of oil on the copy (printed page) as a function of time. In FIG. 3, the dashed line represents operation without the use of embodiments of the disclosure and the solid line represents operation with the use of embodiments of the disclosure. While both operation with and without embodiments of the disclosure result in the same steady-state RAM oil rate, the oil on the first page is substantially reduced when embodiments of the disclosure are used. The shaded regions on the graph represent the oil rate transient operating range for embodiments of the disclosure, which can be optimized by properly setting the cam-in and cam-out timings as well as the metering roll speed ramp up and ramp down. This optimization can be done empirically by varying the mentioned parameters and measuring the oil on copy.

It is noted that the RAM should not be cammed-in to coincide exactly with the first print lead edge since this will cause unwanted disturbances including fusing speed and oil axial lines. Oil axial lines develop during stand-by (idle) from oil on the end faces of the metering roll above the metering blade moving down the face of the roll under the influence of gravity. Capillary pressure moves the oil axially along the top of the metering blade at the point of its contact with the metering roll. It is also noted that camming-in the RAM after a few prints will cause similar issues. As a result, the RAM should be cammed-in before the leading edge of the first print. In addition, the fusing surface benefits from having some oil on it between jobs because this can prolong the release life of the fusing surface.

The exemplary embodiment of a VSM shown in FIG. 2 can assure that all the pages starting from the beginning of a print run get an amount of oil that is within an acceptable range. By using the ramp-up and ramp-down strategy of a VSM of the disclosure along with a traditional RAM camming-in/camming-out strategy, oil rate transients can be reduced. The VSM modifies the oil rate by driving metering roll 330 at a selectable speed instead of the uncontrollable speed resulting from tractive drive by donor roll 340. Tractive drive can be disabled by modifying the donor roll loading method and limiting the load so slip can occur between metering roll 330 and donor roll 340 at reasonable metering roll drive torque.

Unlike some printing systems where a VSM is used to alter the speed of the metering roll from job to job but the speed of the metering roll is consistent for the entire duration on any one print job, embodiments of the disclosure can vary the speed of the metering roll at different points in the same print job.

Embodiments of the disclosure perform the ramp-up and ramp-down process every time there is a pause in printing. An example of the length of pause required to allow the ramp-down, cam-out, cam-in, ramp-up process to complete one cycle is approximately seven seconds, but different lengths of pause may be appropriate depending on the speed of actuators and the optimal duration of the pre and post paper in the fuser cam-in.

Some embodiments of the disclosure include a sensor to sense the amount of oil on the paper and/or the amount of oil on the fusing roll and then adjust the VSM so as to provide the desired ramp-up and ramp-down profiles. In embodiments without such a sensor, a given printing machine can have one set of parameters for all print jobs. This can be the case even if the printing machine has multiple selectable oil rates because the desired ramp-up and ramp-down profiles will be the same as long as the values of particular parameters are the same. The appropriate values for the particular parameters can be determined by experimentation based on the teachings of the disclosure. Examples of the tuning factors (parameters) that can be set to manipulate the ramp-up and ramp-down profiles are: (1) metering roll drive acceleration rate, (2) metering roll drive deceleration rate, (3) time before last print to start deceleration, (4) initial speed during cycle up (before camming), (5) time to cam-in before first print, and (6) time to cam-out after last print.

Although the above description is directed toward fuser apparatuses used in xerographic printing, it will be understood that the teachings and claims herein can be applied to any treatment of marking material on a medium. For example, the marking material can be toner, liquid or gel ink, and/or heat- or radiation-curable ink; and/or the medium can utilize certain process conditions, such as temperature, for successful printing. The process conditions, such as heat, pressure and other conditions that are desired for the treatment of ink on media in a given embodiment may be different from the conditions that are suitable for xerographic fusing.

As used herein, the term "printing apparatus" encompasses any apparatus that performs a print outputting function for any purpose. Such apparatuses can include, e.g., a digital copier, bookmaking machine, multifunction machine, and the like. The printing apparatuses can use various types of solid and liquid marking materials, including toner and inks (e.g., liquid inks, gel inks, heat-curable inks and radiation-curable inks), and the like. The printing apparatuses can use various thermal, pressure and other conditions to treat the marking materials and form images on media.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for controlling transients in the application rate of fuser release agent to a fuser roll during a print job, the apparatus comprising:

a release agent metering roll supported for contact with a supply of release agent material;

a variable speed drive arranged to effect movement of the release agent metering roll in an endless path at different surface velocities;

a donor roll supported in contact with the release agent metering roll and the fuser roll, the donor roll arranged to convey release agent material from the release agent metering roll to the fuser roll at various rates depending on a surface velocity of the release agent metering roll; and a controller that controls a velocity of the variable speed drive such that the surface velocity of the release agent metering roll varies relative to a surface velocity of the fuser roll during the print job, wherein the variable speed drive is operative independently of the fuser roll, a release agent supply rate of release agent supplied to the fuser roll is related to the velocity of the release agent metering roll, the controller controls the velocity of the variable speed drive such that the release agent supply rate is at an idle rate before and after the print job, the controller controls the velocity of the variable speed drive such that the release agent supply rate is at a steady state job rate during a middle portion of the print job, the steady state job rate is larger than the idle rate, the controller controls the velocity of the variable speed drive such that the release agent supply rate is transitioned from the idle rate to the steady state job rate over a predetermined ramp-up period of time at a ramp-up location on the fuser roll, and the ramp-up location begins at a location in front of a location that corresponds to a leading edge of a first sheet of the print job, and the ramp-up location ends at a location behind the location that corresponds to the leading edge of the first sheet of the print job.

2. The apparatus of claim 1, wherein the controller controls the variable speed drive such that the surface velocity of the release agent metering roll and a surface velocity of the fuser roll are different for at least a portion of the print job.

3. The apparatus of claim 2, wherein the controller controls the variable speed drive such that the surface velocity of the release agent metering roll is less than the surface velocity of the fuser roll for a period of time that equals the ramp-up period.

4. The apparatus of claim 1, wherein the controller controls the velocity of the variable speed drive such that the release agent supply rate is transitioned from the steady state job rate to the idle rate over a predetermined ramp-down period of time at a ramp-down location on the fuser roll, and the ramp-down location begins at a location in front of a location that corresponds to a leading edge of a last sheet of the print job, and the ramp-down location ends at a location behind the location that corresponds to the leading edge of the last sheet of the print job.

5. The apparatus of claim 4, wherein the controller controls the variable speed drive such that the surface velocity of the release agent metering roll is less than the surface velocity of the fuser roll for a period of time that equals the ramp-down period.

6. The apparatus of claim 1, wherein the controller controls at least one of:

a release agent metering roll acceleration rate, a release agent metering roll deceleration rate, a duration of time to start deceleration of the release agent metering roll before a last page of the print job contacts the fuser roll, an initial release agent metering roll surface velocity during a cycle up period, a duration of time to cam-in before the first page of the print job contacts the fuser roll, or a duration of time to cam-out after the last page of the print job contacts the fuser roll.

7. A printing apparatus, comprising:

an apparatus for controlling transients in the application rate of fuser release agent to a fuser roll during a print job, the apparatus for controlling having a release agent metering roll supported for contact with a supply of release agent material;

a variable speed drive arranged to effect movement of the release agent metering roll in an endless path at different surface velocities;

a donor roll supported in contact with the release agent metering roll and the fuser roll, the donor roll arranged to convey release agent material from the release agent metering roll to the fuser roll at various rates depending on a surface velocity of the release agent metering roll; and a controller that controls a velocity of the variable speed drive such that the surface velocity of the release agent metering roll varies relative to a surface velocity of the fuser roll during the print job;

an image forming unit that forms images; and a sheet feed unit that feeds sheets to the image forming unit, wherein the variable speed drive is operative independently of the fuser roll, the fuser roll fixes the images to the sheets, a release agent supply rate of release agent supplied to the fuser roll is related to the velocity of the release agent metering roll, the controller controls the velocity of the variable speed drive such that the release agent supply rate is at an idle rate before and after the print job, the controller controls the velocity of the variable speed drive such that the release agent supply rate is at a steady state job rate during a middle portion of the print job, the steady state job rate is larger than the idle rate, the controller controls the velocity of the variable speed drive such that the release agent supply rate is transitioned from the idle rate to the steady state job rate over a predetermined ramp-up period of time at a ramp-up location on the fuser roll, and the ramp-up location begins at a location in front of a location that corresponds to a leading edge of a first sheet of the print job, and the ramp-up location ends at a location behind the location that corresponds to the leading edge of the first sheet of the print job.

8. The apparatus of claim 7, wherein the controller controls the variable speed drive such that the surface velocity of the release agent metering roll and a surface velocity of the fuser roll are different for at least a portion of the print job.

9. The apparatus of claim 8, wherein the controller controls the variable speed drive such that the surface velocity of the release agent metering roll is less than the surface velocity of the fuser roll for a period of time that equals the ramp-up period.

10. The apparatus of claim 7, wherein the controller controls the velocity of the variable speed drive such that the release agent supply rate is transitioned from the steady state job rate to the idle rate over a predetermined ramp-down period of time at a ramp-down location on the fuser roll, and the ramp-down location begins at a location in front of a location that corresponds to a leading edge of a last sheet of the print job, and the ramp-down location ends at a location behind the location that corresponds to the leading edge of the last sheet of the print job.

11. The apparatus of claim 10, wherein the controller controls the variable speed drive such that the surface velocity of the release agent metering roll is less than the surface velocity of the fuser roll for a period of time that equals the ramp-down period.

12. A method for controlling transients in the application rate of fuser release agent to a fuser roll during a print job, the method comprising:

providing a release agent metering roll supported for contact with a supply of release agent material;

providing a variable speed drive arranged to effect movement of the release agent metering roll in an endless path at different surface velocities;

providing a donor roll supported in contact with the release agent metering roll and the fuser roll;

conveying release agent material from the release agent metering roll to the fuser roll at various rates depending on a surface velocity of the release agent metering roll; and controlling a velocity of the variable speed drive such that the surface velocity of the release agent metering roll varies relative to a velocity of the fuser roll during the print job, wherein the variable speed drive is operated independently of the fuser roll, a release agent supply rate of release agent supplied to the fuser roll is related to the velocity of the release agent metering roll, the velocity of the variable speed drive is controlled such that the release agent supply rate is at an idle rate before and after the print job, the velocity of the variable speed drive is controlled such that the release agent supply rate is at a steady state job rate during a middle portion of the print job, the steady state job rate is larger than the idle rate, the velocity of the variable speed drive is controlled such that the release agent supply rate is transitioned from the idle rate to the steady state job rate over a predetermined ramp-up period of time at a ramp-up location on the fuser roll, and the ramp-up location begins at a location in front of a location that corresponds to a leading edge of a first sheet of the print job, and the ramp-up location ends at a location behind the location that corresponds to the leading edge of the first sheet of the print job.

13. The method of claim 12, wherein the velocity of the variable speed drive is controlled such that the release agent supply rate is transitioned from the steady state job rate to the idle rate over a predetermined ramp-down period of time at a ramp-down location on the fuser roll, and the ramp-down location begins at a location in front of a location that corresponds to a leading edge of a last sheet of the print job, and the ramp-down location ends at a location behind the location that corresponds to the leading edge of the last sheet of the print job.

14. The method of claim 13, wherein the variable speed drive is controlled such that the surface velocity of the release agent metering roll is less than the surface velocity of the fuser roll for a period of time that equals the ramp-down period.

15. The method of claim 12, wherein the variable speed drive is controlled such that the surface velocity of the release agent metering roll and a surface velocity of the fuser roll are different for at least a portion of the print job.

16. The method of claim 15, wherein the variable speed drive is controlled such that the surface velocity of the release agent metering roll is less than the surface velocity of the fuser roll for a period of time that equals the ramp-up period.

* * * * *